US007041420B2

(12) United States Patent
Vandewinckel et al.

(10) Patent No.: US 7,041,420 B2
(45) Date of Patent: May 9, 2006

(54) EMULSION AGGREGATION TONER HAVING NOVEL SURFACE MORPHOLOGY PROPERTIES

(75) Inventors: Judith M. Vandewinckel, Livonia, NY (US); Vincenzo G. Marcello, Webster, NY (US); Grazyna E. Kmiecik-Lawrynowicz, Fairport, NY (US); Tie Hwee Ng, Mississauga (CA); Chieh-Min Cheng, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 134 days.

(21) Appl. No.: 10/743,096

(22) Filed: Dec. 23, 2003

(65) Prior Publication Data

US 2005/0136351 A1 Jun. 23, 2005

(51) Int. Cl.
*G03G 15/08* (2006.01)

(52) U.S. Cl. ..... 430/107.1; 430/109.3; 430/110.3; 430/108.3; 430/108.7; 430/108.1; 430/111.4

(58) Field of Classification Search ..... 430/107.1, 430/109.3, 110.3, 108.3, 108.7, 108.1, 111.4
See application file for complete search history.

(56) References Cited

U.S. PATENT DOCUMENTS

| | | | | |
|---|---|---|---|---|
| 5,462,828 | A | 10/1995 | Moffat et al. | |
| 5,585,215 | A * | 12/1996 | Ong et al. | 430/108.2 |
| 5,747,215 | A | 5/1998 | Ong et al. | |
| 5,916,725 | A | 6/1999 | Patel et al. | |
| 6,033,820 | A | 3/2000 | Hayashi et al. | |
| 6,051,350 | A * | 4/2000 | Inaba et al. | 430/45 |
| 6,120,967 | A | 9/2000 | Hopper et al. | |
| 6,183,924 | B1 | 2/2001 | Nomura et al. | |
| 6,210,853 | B1 | 4/2001 | Patel et al. | |
| 6,294,302 | B1 | 9/2001 | Serizawa et al. | |
| 6,329,114 | B1 | 12/2001 | Watanabe et al. | |
| 6,365,316 | B1 | 4/2002 | Stamp et al. | |
| 6,528,224 | B1 * | 3/2003 | Ohno et al. | 430/108.8 |
| 2004/0191666 | A1 * | 9/2004 | Kamada et al. | 430/125 |
| 2005/0136352 | A1 | 6/2005 | Vandewinckel et al. | |
| 2005/0175921 | A1 | 8/2005 | Morris et al. | |

FOREIGN PATENT DOCUMENTS

WO WO 03/087949 A1 10/2003

OTHER PUBLICATIONS

EPO Search Report dated Nov. 29, 2005.

* cited by examiner

*Primary Examiner*—Mark A. Chapman
(74) *Attorney, Agent, or Firm*—Oliff & Berridge, PLC

(57) ABSTRACT

A toner of the invention includes toner particles comprising a styrene acrylate binder and at least one colorant, and wherein the toner particles, in the absence of external additives, have a mean circularity of from about 0.94 to about 0.98 and a particle size distribution with a lower number ratio geometric standard deviation (GSD) of approximately 1.28 to approximately 1.31 and an upper volume GSD of approximately 1.24 to approximately 1.27. Also included is a set of toners for forming a color image, comprising a cyan toner, a magenta toner, a yellow toner and a black toner, wherein each of the cyan toner, the magenta toner, the yellow toner and the black toner, wherein each of about 70 to about 95% by weight, dry basis, of a styrene acrylate binder, about 5 to about 15% by weight, dry basis, of a wax dispersion, and at least one colorant.

19 Claims, No Drawings

EMULSION AGGREGATION TONER HAVING NOVEL SURFACE MORPHOLOGY PROPERTIES

BACKGROUND OF THE INVENTION

1. Field of Invention

This invention relates to toners and developers containing the toners for use in forming and developing images of good quality and gloss, and in particular to a novel set of surface morphology properties of the toner particles that achieve such advantageous results.

2. Description of Related Art

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215.

Two main types of emulsion aggregation toners are known. First is an emulsion aggregation process that forms acrylate based, e.g., styrene acrylate, toner particles. See, for example, U.S. Pat. No. 6,120,967, incorporated herein by reference in its entirety, as one example of such a process. Second is an emulsion aggregation process that forms polyester, e.g., sodio sulfonated polyester. See, for example, U.S. Pat. No. 5,916,725, incorporated herein by reference in its entirety, as one example of such a process.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence/fusing, thereby achieving aggregated, fused toner particles.

U.S. Pat. No. 5,462,828 describes a toner composition that includes a styrene/n-butyl acrylate copolymer resin having a number average molecular weight of less than about 5,000, a weight average molecular weight of from about 10,000 to about 40,000 and a molecular weight distribution of greater than 6 that provides excellent gloss and high fix properties at a low fusing temperature.

What is still desired is a styrene acrylate type emulsion aggregation toner that can achieve excellent print quality, particularly gloss, for all colors.

SUMMARY OF THE INVENTION

The present invention comprises a toner having a combination of surface morphology properties that enable the toner to achieve the objects of the invention, mainly to achieve a toner exhibiting excellent gloss properties.

The toner of the invention includes toner particles comprising a styrene acrylate binder and at least one colorant, and wherein the toner particles, in the absence of external additives, have a mean circularity of from about 0.94 to about 0.98 and a particle size distribution with a lower number ratio geometric standard deviation (GSD) of approximately 1.28 to approximately 1.31 and an upper volume GSD of approximately 1.24 to approximately 1.27.

The invention also includes a set of toners for forming a color image, comprising a cyan toner, a magenta toner, a yellow toner and a black toner, wherein each of the cyan toner, the magenta toner, the yellow toner and the black toner comprise toner particles comprised of about 70 to about 95% by weight, dry basis, of a styrene acrylate binder, about 5 to about 15% by weight, dry basis, of a wax dispersion, and at least one colorant, and wherein the toner particles, in the absence of external additives, have a mean circularity of from about 0.94 to about 0.98 and a particle size distribution with a lower number ratio geometric standard deviation (GSD) of approximately 1.28 to approximately 1.31 and an upper volume GSD of approximately 1.24 to approximately 1.27.

DETAILED DESCRIPTION OF PREFERRED EMBODIMENTS

The toner of the invention is comprised of toner particles comprised of at least a latex emulsion polymer resin and a colorant dispersion. The toner particles preferably also include at least a wax dispersion, a coagulant and a colloidal silica.

Illustrative examples of specific latex for resin, polymer or polymers selected for the toner of the present invention include, for example, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers or other similar known polymers.

As the latex emulsion polymer of the inventive toner, preferably a styrene-alkyl acrylate is used. More preferably, the styrene-alkyl acrylate is a styrene/n-butyl acrylate copolymer resin, and most preferably, a styrene-butyl acrylate beta-carboxyethyl acrylate polymer.

The latex polymer is preferably present in an amount of from about 70 to about 95% by weight of the toner particles (i.e., toner particles exclusive of external additives) on a solids basis, preferably from about 75 to about 85% by weight of the toner.

The monomers used in making the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Known chain transfer agents, for example dodecanethiol or carbon tetrabromide, can be utilized to control the molecular weight properties of the polymer. Any suitable method for forming the latex polymer from the monomers may be used without restriction.

Various suitable colorants can be employed in toners of the present invention, including suitable colored pigments, dyes, and mixtures thereof, including carbon black, such as REGAL 330 carbon black, acetylene black, lamp black, aniline black, Chrome Yellow, Zinc Yellow, SICOFAST Yellow, SUNBRITE Yellow, LUNA Yellow, NOVAPERM Yellow, Chrome Orange, BAYPLAST Orange, Cadmium Red, LITHOL Scarlet, HOSTAPERM Red, FANAL PINK, HOSTAPERM Pink, LUPRETON Pink, LITHOL Red, RHODAMINE Lake B, Brilliant Carmine, HELIOGEN Blue, HOSTAPERM Blue, NEOPAN Blue, PV Fast Blue, CINQUASSI Green, HOSTAPERM Green, titanium dioxide, cobalt, nickel, iron powder, SICOPUR 4068 FF, and iron oxides such as MAPICO Black (Columbia) NP608 and NP604 (Northern Pigment), BAYFERROX 8610 (Bayer), M08699 (Mobay), TMB-100 (Magnox), mixtures thereof and the like.

The colorant, preferably carbon black, cyan, magenta and/or yellow colorant, is incorporated in an amount sufficient to impart the desired color to the toner. In general, pigment or dye is employed in an amount ranging from about 2% to about 35% by weight of the toner particles on a solids basis, preferably from about 5% to about 25% by weight and more preferably from about 5 to about 15% by weight.

Of course, as the colorants for each color are different, the amount of colorant present in each type of color toner typically is different. For example, in preferred embodiments of the present invention, a cyan toner may include about 8 to about 11% by weight of colorant (preferably Pigment Blue 15:3 from SUN), a magenta toner may include about 7 to about 15% by weight of colorant (preferably Pigment Red 122, Pigment Red 185, and/or mixtures thereof), a yellow toner may include about 5 to about 8% by weight of colorant (preferably Pigment Yellow 74), and a black toner may include about 5 to about 8% by weight of colorant (preferably carbon black).

In addition to the latex polymer binder and the colorant, the toners of the invention also contain a wax dispersion. The wax is added to the toner formulation in order to aid toner release from the fuser roll, particularly in low oil or oil-less fuser designs. For emulsion/aggregation (E/A) toners, for example styrene-acrylate E/A toners, linear polyethylene waxes such as the POLYWAX® line of waxes available from Baker Petrolite are useful. POLYWAX® 725 is a particularly preferred wax for use with styrene-acrylate E/A toners.

To incorporate the wax into the toner, it is preferable for the wax to be in the form of an aqueous emulsion or dispersion of solid wax in water, where the solid wax particle size is usually in the range of from about 100 to about 500 nm.

The toners may contain from, for example, about 5 to about 15% by weight of the toner, on a dry basis, of the wax. Preferably, the toners contain from about 8 to about 11% by weight of the wax.

In addition, the toners of the invention may also optionally contain a coagulant and a flow agent such as colloidal silica. Suitable optional coagulants include any coagulant known or used in the art, including the well known coagulants polyaluminum chloride (PAC) and/or polyaluminum sulfosilicate (PASS). A preferred coagulant is polyaluminum chloride. The coagulant is present in the toner particles, exclusive of external additives and on a dry weight basis, in amounts of from 0 to about 3% by weight of the toner particles, preferably from about greater than 0 to about 2% by weight of the toner particles. The flow agent, if present, may be any colloidal silica such as SNOWTEX OL/OS colloidal silica. The colloidal silica is present in the toner particles, exclusive of external additives and on a dry weight basis, in amounts of from 0 to about 15% by weight of the toner particles, preferably from about greater than 0 to about 10% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Also, in preparing the toner by the emulsion aggregation procedure, one or more surfactants may be used in the process. Suitable surfactants include anionic, cationic and nonionic surfactants.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a preferred anionic surfactant is NEOGEN RK available from Daiichi Kogyo Seiyaku Co. Ltd., which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a preferred cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a preferred nonionic surfactant is ANTAROX 897 available from Rhone-Poulenc Inc., which consists primarily of alkyl phenol ethoxylate.

Any suitable emulsion aggregation procedure may be used in forming the emulsion aggregation toner particles without restriction. These procedures typically include the basic process steps of at least aggregating an emulsion containing binder, one or more colorants, optionally one or more surfactants, optionally a wax emulsion, optionally a coagulant and one or more additional optional additives to form aggregates, subsequently coalescing or fusing the aggregates, and then recovering, optionally washing and optionally drying the obtained emulsion aggregation toner particles.

An example emulsion/aggregation/coalescing process preferably includes forming a mixture of latex binder, colorant dispersion, optional wax emulsion, optional coagulant and deionized water in a vessel. The mixture is then stirred using a homogenizer until homogenized and then transferred to a reactor where the homogenized mixture is heated to a temperature of, for example, about 50° C. and held at such temperature for a period of time to permit aggregation of toner particles to the desired size. Once the desired size of aggregated toner particles is achieved, the pH of the mixture is adjusted in order to inhibit further toner aggregation. The toner particles are further heated to a temperature of, for example, about 90° C. and the pH lowered in order to enable the particles to coalesce and spherodize. The heater is then turned off and the reactor mixture allowed to cool to room temperature, at which point the aggregated and coalesced toner particles are recovered and optionally washed and dried.

Most preferably, following coalescence and aggregation, the particles are wet sieved through an orifice of a desired size in order to remove particles of too large a size, washed and treated to a desired pH, and then dried to a moisture content of, for example, less than 1% by weight.

The toner particles of the invention are preferably made to have the following physical properties when no external additives are present on the toner particles.

The toner particles preferably have a surface area, as measured by the well known BET method, of about 1.3 to about 6.5 $m^2/g$. More preferably, for cyan, yellow and black toner particles, the BET surface area is less than 2 $m^2/g$, preferably from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In a preferred embodiment, the toner particles have a very narrow particle size distribution with a lower number ratio geometric standard deviation (GSD) of approximately 1.28 to approximately 1.31, more preferably approximately 1.30. The toner particles of the invention also preferably have a size such that the upper geometric standard deviation (GSD) by volume is in the range of from about 1.20 to about 1.30, preferably from about 1.24 to about 1.27, more preferably about 1.26. These GSD values for the toner particles of the invention indicate that the toner particles are made to have a very narrow particle size distribution.

Another preferred property of the toner particles is to have a porosity, as measured by the known mercury porosimetry method, such that the average pore diameter is from about 40 to about 75 nm at 4V/S, preferably from about 45 to about 70 nm, and the total pore volume is about 1.2 to about 1.6 ml/g, preferably about 1.3 to about 1.5 ml/g.

Shape factor is also an important control process parameter associated with the toner being able to achieve optimal machine performance. The toner particles of the invention preferably have a shape factor of about 105 to about 170, more preferably about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\ \pi d^2/(4A)$, where A is the area of the particle and d is its major axis. A perfectly circular or spherical particle has a shape factor of exactly 100. The shape factor SF1*a increases as the shape becomes more elongated or needle-like.

The toner particles cohesivity is associated to some degree with the surface morphology of the particles. The more round/smoother the surface of the particles, the lesser the cohesion and the greater the flow. As the surface becomes less round/rougher, the flow worsens and the cohesion increases. The toner particles of the invention preferably have a mean circularity of from about 0.94 to about 0.98, as determined by testing with a SYSMEX FPIA2100.

In addition to the foregoing surface morphology properties, it has also been found that the amount of certain elements present in the toner particles is an important factor associated with the performance of the toners. For example, the amount of calcium present in the toners has been found to be related to the triboelectric performance of the toner. Preferably, the toner particles contain from 0 to about 240 ppm calcium, more preferably from above 0 to about 220 ppm calcium. Most preferably, the amount of calcium varies based upon the color of the toner. Cyan toner preferably includes about 1 to about 30 ppm calcium, magenta toner contains about 20 to about 220 ppm calcium, yellow toner contains about 30 to about 55 ppm calcium, and black toner contains about 0 to about 30 ppm calcium.

For the toners of the invention having the aforementioned calcium contents, the toners preferably exhibit a triboelectric value, as determined using the complementary well known Faraday cage measurement, of about 40 to about 100 μC/g, preferably about 55 to about 95 μC/g, non-blended. Non-blended toner is toner that does not have any surface additives added or blended on to the surface to adjust the charging properties of the toner.

It has further been found that the toners of the invention preferably have a copper content of from 0 to about 80 μg/g, a bulk aluminum content (from, e.g., the PAC) of about 500 to about 800 μg/g and a sodium content of about 300 to about 600 μg/g.

In addition to the foregoing, the toner particles of the present invention also have the following rheological and flow properties. First, the toner particles preferably have the following molecular weight values, each as determined by gel permeation chromatography (GPC) as known in the art. The binder of the toner particles preferably has a weight average molecular weight of from about 20 to about 30 kpse.

Overall, the toner particles of the invention preferably have a weight average molecular weight (Mw) in the range of about 28 to about 130 kpse, a number average molecular weight (Mn) of about 9 to about 13.4 kpse, and a MWD of about 2.2 to about 10. MWD is a ratio of the Mw to Mn of the toner particles, and is a measure of the polydispersity, or width, of the polymer. For cyan and yellow toners, the toner particles preferably exhibit a weight average molecular weight (Mw) of about 24 to about 34 kpse, a number average molecular weight (Mn) of about 9 to about 11 kpse, and a MWD of about 2.5 to about 3.3. For black and magenta, the toner particles preferably exhibit a weight average molecular weight (Mw) of about 30 to about 130 kpse, a number average molecular weight (Mn) of about 10 to about 14 kpse, and a MWD of about 2 to about 10.

Further, the toners of the present invention preferably have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values for the binder. Molecular peak is the value that represents the highest peak of the weight average molecular weight. In the present invention, the binder preferably has a molecular peak (Mp) in the range of from about 23 to about 28, preferably from about 23.5 to about 27.4 kpse. The toner particles prepared from such binder also exhibit a high molecular peak, for example of about 25 to about 30, preferably about 26 to about 27.8 kpse, indicating that the molecular peak is driven by the properties of the binder rather than another component such as the colorant.

Another property of the toners of the present invention is the cohesivity of the particles prior to inclusion of any external additives. The greater the cohesivity, the less the toner particles are able to flow. The cohesivity of the toner particles, prior to inclusion of any external additives, may be from, for example, about 55 to about 98% for all colors of the toner. Cohesivity was measured by placing a known mass of toner, for example two grams, on top of a set of three screens, for example with screen meshes of 53 microns, 45 microns, and 38 microns in order from top to bottom, and vibrating the screens and toner for a fixed time at a fixed vibration amplitude, for example for 115 seconds at a 1 millimeter vibration amplitude. A device to perform this measurement is a Hosokawa Powders Tester, available from Micron Powders Systems. The toner cohesion value is related to the amount of toner remaining on each of the screens at the end of the time. A cohesion value of 100% corresponds to all of the toner remaining on the top screen at the end of the vibration step and a cohesion value of zero corresponds to all of the toner passing through all three screens, that is, no toner remaining on any of the three screens at the end of the vibration step. The higher the cohesion value, the lesser the flowability of the toner.

Still further, the toner particles preferably have a melt flow index (MFI) of from about 18 to about 37 g/10 min. The melt flow index values relate to the stripping force and gloss values of the toner. The stripping force range at 170° C. is from, for example, about 7 to about 18 mg/cm$^2$, and the gloss ranges from, for example, about 55 to about 68 ggu (grams per gloss units) for TMA, 1.03 mg/cm$^2$. The relationship among these properties is substantially linear, with each value decreasing as the elastic modulus (G') increases. The elastic modulus of the toner particles preferably ranges from about 89,000 to about 130,000 dyn/cm$^2$ at 120° C./10 rad/sec.

Finally, the toner particles preferably have a bulk density of from about 0.22 to about 0.34 g/cc and a compressibility of from about 33 to about 51.

The toner particles of the invention are preferably blended with external additives following formation. Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as Zinc Stearate L, obtained from Ferro Corporation. The external surface additives can be used with or without a coating.

Most preferably, the toners contain from, for example, about 0.1 to about 5 weight percent titania, about 0.1 to about 8 weight percent silica and about 0.1 to about 4 weight percent zinc stearate.

The toner particles of the invention can optionally be formulated into a developer composition by mixing the toner particles with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2% to about 10% by weight of toner and about 90% to about 98% by weight of carrier. However, one skilled in the art will recognize that different toner and carrier percentages may be used to achieve a developer composition with desired characteristics.

Toners of the present invention can be used in known electrostatographic imaging methods. Thus for example, the toners or developers of the invention can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet.

The toner image can then be fused to the support by application of heat and/or pressure, for example with a heated fuser roll.

It is envisioned that the toners of the present invention may be used in any suitable procedure for forming an image with a toner, including in applications other than xerographic applications.

Those skilled in the art will recognize that certain variations and/or additions can be made in the foregoing illustrative embodiments. It is apparent that various alternatives and modifications to the embodiments can be made thereto. It is, therefore, the intention in the appended claims to cover all such modifications and alternatives as may fall within the true scope of the invention.

What is claimed is:

1. A toner including toner particles comprising a styrene acrylate binder and at least one colorant, and wherein the toner particles, in the absence of external additives, have a mean circularity of from about 0.94 to about 0.98 and a particle size distribution with a lower number ratio geometric standard deviation (GSD) of approximately 1.28 to approximately 1.31 and an upper volume GSD of approximately 1.24 to approximately 1.27.

2. The toner according to claim 1, wherein the binder comprises about 75 to about 85% by weight of the toner particles on a solids basis.

3. The toner according to claim 1, wherein the toner particles further comprise a wax dispersion.

4. The toner according to claim 3, wherein the wax dispersion is present in an amount of about 8 to about 11% by weight of the toner particles on a solids basis.

5. The toner according to claim 1, wherein the toner is a cyan toner, and the at least one colorant is present in an amount of about 5 to about 8% by weight of the toner particles on a solids basis and has a calcium content of from about 1 to about 30 ppm.

6. The toner according to claim 1, wherein the toner is a magenta toner, and the at least one colorant is present in an amount of about 7 to about 15% by weight of the toner particles on a solids basis and has a calcium content of from about 20 to about 220 ppm.

7. The toner according to claim 1, wherein the toner is a yellow toner, and the at least one colorant is present in an amount of about 5 to about 8% by weight of the toner particles on a solids basis and has a calcium content of from about 30 to about 55 ppm.

8. The toner according to claim 1, wherein the toner is a black toner, and the at least one colorant is present in an amount of about 5 to about 8% by weight of the toner particles on a solids basis and has a calcium content of from about 0 to about 30 ppm.

9. The toner according to claim 1, wherein the toner particles further comprise polyaluminum chloride in an amount up to about 2% by weight of the toner particles on a solids basis.

10. The toner according to claim 1, wherein the toner particles further comprise a colloidal silica in an amount up to about 10% by weight of the toner particles on a solids basis.

11. The toner according to claim 1, wherein the toner particles a BET surface area of about 1.3 to about 6.5 $m^2/g$.

12. The toner according to claim 1, wherein the toner particles have an average pore diameter is from about 40 to about 70 nm at 4V/S and a total pore volume of about 1.3 to about 1.5 ml/g.

13. The toner according to claim 1, wherein the toner particles have a shape factor of about 110 to about 160 SF*a.

14. The toner according to claim 1, wherein the toner particles have a triboelectric value of about 40 to about 100 μC/g.

15. The toner according to claim 1, wherein the toner particles have a copper content of from 0 to about 80 μg/g, a bulk aluminum content of about 500 to about 800 μg/g and a sodium content of about 300 to about 600 μg/g.

16. The toner according to claim 1, wherein the toner particles further comprise one or more external additives selected from the group consisting of silica, titanium dioxide and zinc stearate.

17. The toner according to claim 1, wherein the toner particles are further mixed with carrier particles.

18. A set of toners for forming a color image, comprising a cyan toner, a magenta toner, a yellow toner and a black toner, wherein each of the cyan toner, the magenta toner, the yellow toner and the black toner comprise toner particles comprised of about 70 to about 95% by weight, dry basis, of a styrene acrylate binder, about 5 to about 15% by weight, dry basis, of a wax dispersion, and at least one colorant, and wherein the toner particles, in the absence of external additives, have a mean circularity of from about 0.94 to about 0.98 and a particle size distribution with a lower number ratio geometric standard deviation (GSD) of approximately 1.28 to approximately 1.131 and an upper volume GSD of approximately 1.24 to approximately 1.27.

19. The set of toners according to claim 18, wherein the toner particles of the cyan have a calcium content of about 1 to about 30 ppm on a solids basis, the toner particles of the magenta toner have a calcium content of from about 20 to about 220 ppm on a solids basis, the toner particles of the yellow toner have a calcium content of from about 30 to about 55 ppm on a solids basis, and the toner particles of the black toner have a content of from about 0 to about 30 ppm on a solid basis.

* * * * *